US005666682A

United States Patent [19]

Bonaddio et al.

[11] Patent Number: 5,666,682

[45] Date of Patent: Sep. 16, 1997

[54] MATTRESS PAD OF ADJUSTABLE SIZE

[76] Inventors: Vincenzo A. Bonaddio; Jose DeJesus M. Contreras, both of 2060 N. Batavia St., Orange, Calif. 92665

[21] Appl. No.: 315,424

[22] Filed: Sep. 30, 1994

[51] Int. Cl.[6] ..... A47C 27/14

[52] U.S. Cl. ..... 5/736; 5/901; 5/690

[58] Field of Search ..... 5/481, 901, 903, 5/501, 690, 736

[56] References Cited

U.S. PATENT DOCUMENTS

| | | | |
|---|---|---|---|
| 2,183,418 | 12/1939 | Williams . | |
| 2,785,739 | 3/1957 | McGregor, Jr. et al. . | |
| 2,902,091 | 9/1959 | Dahle . | |
| 3,197,357 | 7/1965 | Schlpen . | |
| 3,431,802 | 3/1969 | Schulpen . | |
| 3,530,516 | 9/1970 | Marquette . | |
| 4,096,306 | 6/1978 | Larson . | |
| 4,097,210 | 6/1978 | Romanillos . | |
| 4,399,574 | 8/1983 | Schuman . | |
| 4,603,445 | 8/1986 | Spann . | |
| 4,620,337 | 11/1986 | Williams et al. . | |
| 4,631,765 | 12/1986 | Casey . | |
| 4,686,724 | 8/1987 | Bedford . | |
| 4,686,725 | 8/1987 | Mitchell . | |
| 4,700,447 | 10/1987 | Spann . | |
| 4,741,058 | 5/1988 | Williams et al. | 5/901 |
| 4,825,488 | 5/1989 | Bedford . | |
| 5,252,278 | 10/1993 | Spann et al. . | |
| 5,327,597 | 7/1994 | Rothbard | 5/901 |

FOREIGN PATENT DOCUMENTS

| | | | |
|---|---|---|---|
| 548789 | 7/1956 | Belgium | 5/481 |

*Primary Examiner*—Michael J. Milano

[57] ABSTRACT

A foam mattress pad of adjustable size has an initial predetermined length, width and thickness. The pad is provided with punched areas or holes, preferably in rows or columns forming a guide for cutting or tearing away strips of foam material to decrease the size dimensions of the pad. In a preferred embodiment, the holes are formed in rows or columns in the base of troughs between peaks of a convoluted surface of the mattress pad. The holes in the troughs may be separately punched or cut before or after the foam is convoluted. Preferably, the holes in the troughs are formed as the foam is cut by the band knife blade during one pass between convolute rollers. Longer projecting fingers are applied to some portions of the convolute roller to achieve the holes in the bases of the troughs. The mattress pad so formed may be sold in a large size, such as queen or king, and reduced by the consumer to a desired smaller size, such as twin or full, by tearing or cutting away strips of foam material along the punched area guide.

11 Claims, 2 Drawing Sheets

MATTRESS PAD OF ADJUSTABLE SIZE

BACKGROUND OF THE INVENTION

The present invention relates to mattress pads or cushions or mattress toppers that are commonly formed from polyurethane foam. Such pads are intended to be placed on top of existing mattresses to provide more comfortable support to a reclining person.

Presently, mattress pads, like fitted sheets, are available in predetermined lengths and widths that conform to the lengths and widths of mattresses, i.e., twin, full, queen and king. Mattress pads are factory cut to match the "standard" predetermined lengths and widths of conventional mattress sizes. The various sized pads are then packaged, separately marked as twin, full, queen and king.

A single mattress pad where the consumer could readily adjust the size to fit one or more particular applications has not been available. Nor have mattress pads with perforations or cutting guides to allow the consumer to adjust the size of the pad been available or disclosed in the art.

A method for perforating foam mattress pads is shown in U.S. Pat. No. 4,097,210 (Romanillos). However, Romanillos teaches perforating the foam during the foam forming process to increase the escape of gas and allow a smooth flat top foam surface (col. 1, lines 56–60).

In U.S. Pat. No. 4,825,488 (Bedford) a foam support pad for nonambulatory persons has portions of the pad that are detachable along perforations to allow insertion of pad sections that include special fans to give increased air circulation beneath the patient (col. 2, lines 47–54). Bedford does not teach adjustment of the size of the pad to fit on various-sized mattresses.

U.S. Pat. No. 4,686,725 (Mitchell) discloses a mattress cushion that may be split into two or more units by the manufacturer at the factory for convenience in packaging, shipping or manufacturing (Col. 4, line 62). Mitchell does not disclose a pad that may be reduced in size by removing portions of the foam material along perforations or cutting guides.

Convoluting of polyurethane foam is well known. Convoluting provides the foam pad with a contoured surface of peaks and troughs or ridges and troughs. Examples of convoluting processes are described in U.S. Pat. Nos. 2,902,091 (Dahle), 3,197,357 (Schulpen), 3,431,802 (Schulpen II), and 4,603,445 (Spann).

Punching ventilation holes through the thickness of a mattress pad in a second step after the pad has been formed by convoluting a foam slab is taught in the art. See, e.g. U.S. Pat. No. 4,686,724 (Bedford) at col. 2, lines 30–35.

Ventilation holes may also be cut into the foam during a specialized convoluting method using an auxiliary with the foam pad that is to be convoluted. As described in U.S. Pat. No. 4,603,445 (Spann), at Col. 5, lines 46–55, for example, the auxiliary pad "increases" the foam slab thickness that passes through the convoluter rolls. The increase in thickness permits the convoluter to cut or punch holes through the foam pad. Thereafter, the auxiliary pad is peeled away to reveal the pad with voids or vents (FIGS. 11 and 12 of Spann). Spann also suggests that smaller ventilation holes or voids 43 may be provided in the pad if less compression is applied when the foam is sandwiched between auxiliary pads and this sandwich is passed through the convoluter rolls (Col. 6, lines 29–33).

One of the objects of the present invention is to form a size adjusting mattress pad where a tearing or cutting guide is provided in the mattress pad. A further object of the present invention is to provide the tearing or cutting guide in a convoluted foam mattress pad by forming holes in the trough between the peaks of the convoluted mattress pad when the foam slab is passed through the convoluter rolls and cut with the knife blade adjacent to those rolls.

SUMMARY OF THE INVENTION

A polyurethane foam mattress pad of predetermined length, width and thickness is provided with punched areas substantially forming holes through the thickness of the pad that form a guide for cutting or tearing to remove a portion of the foam to decrease the size of the pad. Preferably, the mattress pad has a convoluted upper surface and the lower base surface is substantially flat for placement on a mattress. The punched areas may be provided by punching holes through the pad with a punch or other die cut means. However, preferably the punched areas are formed in one step at the same time the foam pad is convoluted.

Most preferably, the holes are formed between the peaks of the convoluted surface and are provided in a row along the length of the pad so that a strip of foam may be removed by tearing or cutting along the row. More than one row of holes may be provided in the foam mattress.

The mattress pad may have a length and width to approximately conform or correspond to the length and width of a king, queen or standard mattress. A preferred mattress pad has a width to approximately conform to the width of a queen-sized mattress and a punched area or row of holes to enable the customer to remove a strip of foam to reduce the pad width to about the width of a standard full bed. The same mattress pad may also have another punched area or row of holes to enable the customer to remove a strip of foam to reduce the pad width to about the width of a twin-sized bed.

A method for forming a foam mattress pad of adjustable size involves convoluting a slab of foam material by passing the slab between convoluter rolls having projecting fingers or ridges positioned so that at least some of the fingers of one roll intermesh with the fingers of another roll to compress the foam. The slab is cut with a band knife blade positioned adjacent to the convoluter rolls so that the foam slab forms two foam pads having peaks and troughs. The foam material is removed from at least some of the troughs of one of the pads to form holes between the peaks. Preferably, the holes are formed when the foam material is cut by the band knife. Most preferably, some of the projecting fingers on at least one of the convoluter rolls are longer than the other projecting fingers so that the band knife cuts away all of the foam material in the trough of at least one of the foam pads forming a hole in the trough. The long projecting fingers preferably are long enough to contact or nearly contact/touch the space between projecting fingers on the convoluter rolls when the fingers are engaged or intermeshed. The long projecting fingers may be positioned in a pattern so as to form a row or a column pattern of holes in the mattress pad.

A method of adjusting the size of a mattress pad involves tearing or cutting a strip of foam material from a polyurethane mattress pad of predetermined length, width and thickness. The strip of removed material may be used as a pillow or cushioning material. Preferably, punched areas or holes are provided as guides for cutting or tearing the strip so that strips may be removed to adjust a king- or queen-sized mattress pad to fit on a smaller mattress, such as a full-sized or twin-sized bed mattress.

DESCRIPTION OF THE PREFERRED EMBODIMENT

Figure 1:
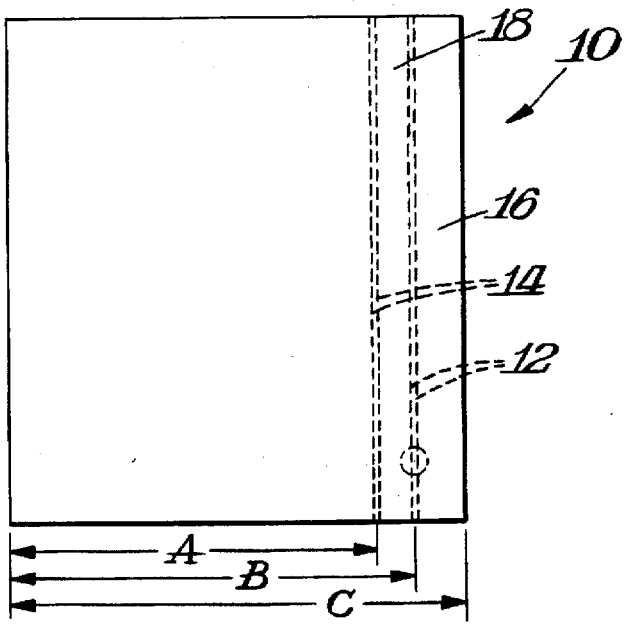
FIG. 1 is a top plan view of a mattress pad showing punches or holes used as tearing or cutting guides to produce a twin or full-size mattress pad from a queen-size mattress pad of the invention.

Referring to FIG. 1 a mattress pad 10 according to the invention is formed of polyurethane foam. Preferably, the pad is formed out of flexible slabstock polyurethane foam having a density of about 1 to 2 pounds per cubic foot, most preferably 1.05 to 1.8 pounds per cubic foot, and an indentation force deflection ("IFD") of about 20 to 45 pounds. The IFD of a foam is determined by an Indentation Force Deflection Test, which measures the force needed to compress the foam sample to 25% of its initial thickness after being held in the compressed position for one minute. Normally, the loading platen used in the IFD test has a circular area of 50 $in^2$.

The length of the pad is preferably selected to fit atop a bed mattress, generally about 78–80 inches. The thickness of the pad can vary in the range from about one to four inches. If the pad is convoluted, the peak height, measured from the lower surface to the top of the peak, generally can be from about one to four inches, preferably about one to two inches, most preferably, 1½ to 2 inches. The base thickness, measured from the lower surface, generally will be in the range from zero to about ½ inch. Where there is a zero base, a hole is cut through the width of the pad.

The width of the mattress pad 10 is selected to conform the pad to the width of an industry standard mattress, such as king, queen, full or twin. In the preferred embodiment the mattress pad has a width of about 58–60 inches, to conform to a queen-sized mattress (Dimension C as shown in FIG. 1).

The pad 10 is provided with punched areas 12 and 14 that are holes or perforations cut through the thickness of the pad 10. The punched areas 12 and 14 shown in FIG. 1 are provided in straight rows, but it should be apparent that the punched areas might be provided in other configurations.

Punched areas 12 are provided about 6 to 8 inches from the side edge of the mattress pad (Dimension B as shown in FIG. 1). If an individual desires to use the mattress pad 10 atop a full-sized mattress rather than a queen-sized mattress, the pad is tom or cut along the punched area 12 to remove the outer edge strip 16 of foam material.

Alternatively, if the mattress pad is to be used atop a twin size mattress, the pad is torn or cut along the punched areas 14 to remove the thicker outer edge strip 18 of foam material. Punched areas 14 are provided about 10–12 inches from the side edge of the pad. The mattress pad (Dimension A as shown in FIG. 1) is then suitable for placing atop a twin-sized bed mattress.

The removed strips 16 or 18 may be discarded or used for cushioning material in various applications. For example, the removed strip may be folded or rolled and placed in a casing to form a pillow or cushion. The removed strip also may be used as a packaging material. It may also be wrapped around cushions or seats, such as bicycle seats to reduce pressure build up and soreness.

Figure 2:
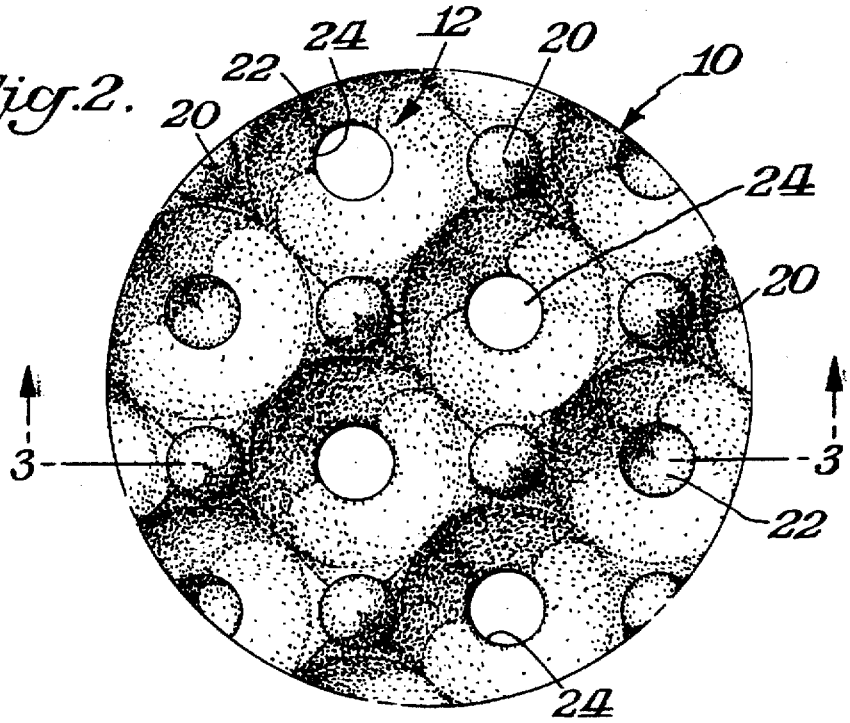
FIG. 2 is a top plan view of the read-out circled area of FIG. 1 showing in greater detail the peaks, valleys and punched through areas of the convoluted surface of the mattress pad of the invention.

Referring to FIG. 2, a preferred mattress pad 10 according to the invention is convoluted and has a top surface with peaks 20 and troughs 22 in straight rows. The punched areas 12 comprise holes 24 disposed between the peaks 20, most preferably, the holes 24 are formed in troughs 22 between the peaks 20, such that rows of holes 24 and peaks 20 are formed.

Figure 3:
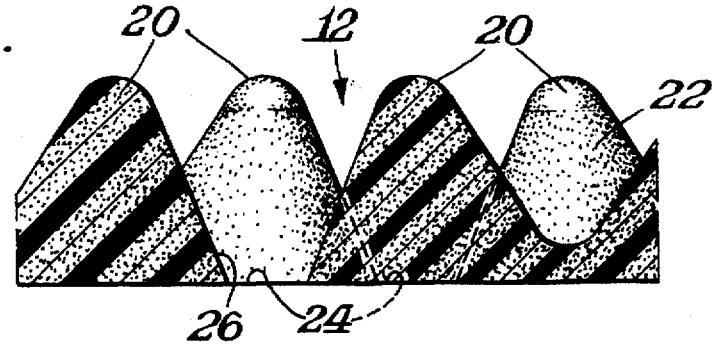
FIG. 3 is a cross-sectional view taken along line 3—3 of FIG. 2.

As shown in FIG. 3, the holes 24 are formed only between certain of the peaks 20. Valleys or troughs 22 are formed between other peaks 20 outside of the punched areas 12. Of course, holes may be cut through the pad in other positions to provide greater air ventilation.

The holes may be formed before or after the foam slab is convoluted by punching or cutting the foam in a step separate from the convoluting step. The preferred method for forming the holes in the foam pad is to form the holes in the troughs between the peaks in one step during the convoluting process and without using any auxiliary pad or sheet with the foam slab.

Figure 4:
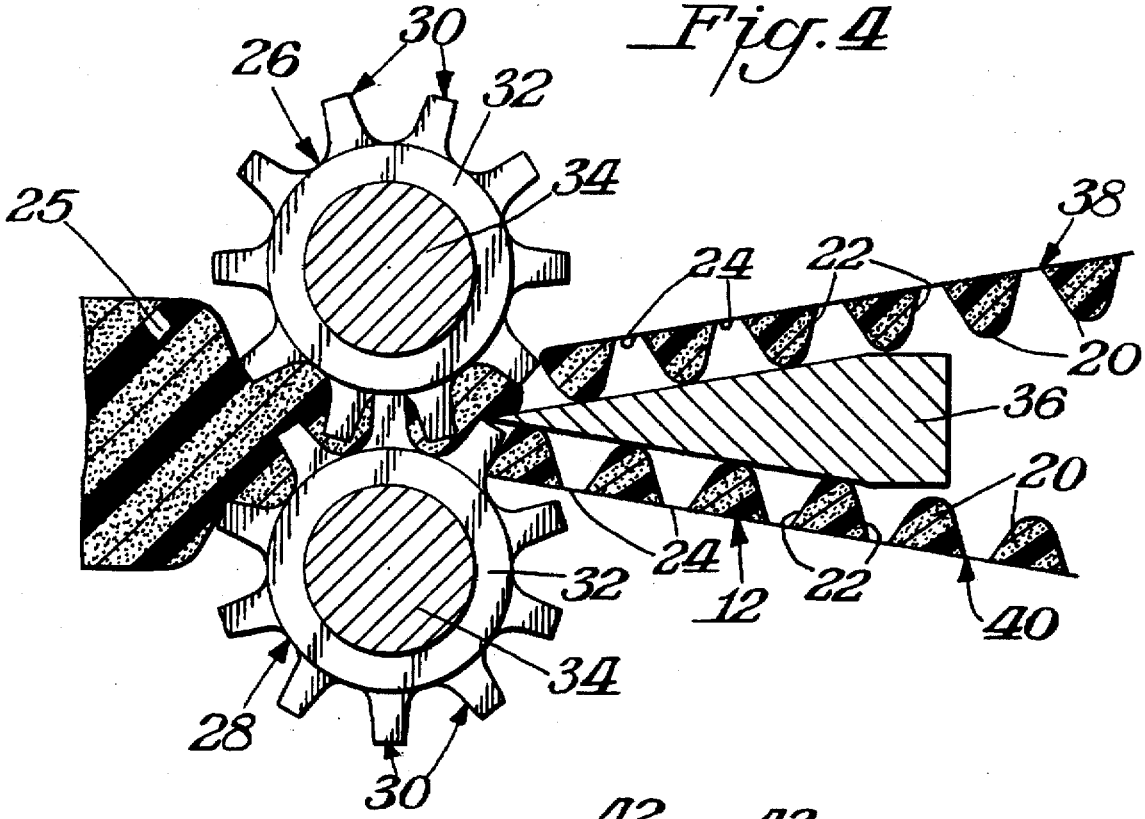
FIG. 4 is a side elevational view in cross-section showing the foam slab passing between convoluting rollers and cut by the convoluting knife blade.

As shown in FIG. 4, a foam slab 25 is fed between two convolute rolls 26, 28. The foam slab 25 is compressed between the rollers 26, 28. Each convolute roll is provided with spaced apart projecting fingers 30 on convolute rings 32 mounted on a shaft 34. The extent to which the foam is compressed may be adjusted by adjusting the space or distance between the convolute roller shafts 34. Each convolute roll normally will have a series of convolute rings 32 that may be positioned and adjusted to change the profile of the convoluted surface of the foam pads. The projecting fingers 30 preferably have a substantially flat upper surface.

The foam slab 25 is compressed between the convolute rolls and the projecting fingers 30. Portions of the foam slab 25 are compressed to a greater extent by the projecting fingers 30. The foam slab 25 is sliced or cut into two pieces just before it emerges from the convolute rolls by a band knife blade 36. The portions of the foam compressed by the projecting fingers 30, are cut to a greater extent than other portions of the foam. The two cut parts of the foam form convolute foam pads 38, 40 and have peaks 20 and troughs 22.

Figure 5:
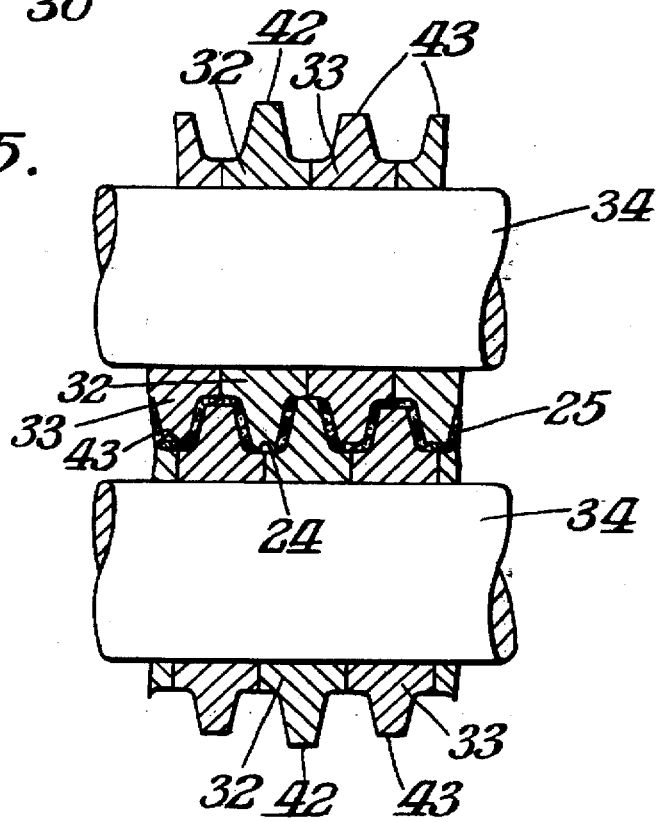
FIG. 5 is a partial end elevational view of FIG. 4 in cross-section showing the foam slab passing between convoluting rollers with projecting fingers of rings on convoluting rollers intermeshed.

To form a punched area 12 with holes 24 in the troughs 22 between some of the peaks 20 of the foam pad 38, the projecting fingers 42 on one or more convolute rings 32 on the shaft 34 of the convolute rolls 26 and 28 are somewhat longer in length than the projecting fingers 43 on other convolute rings 33 on the convolute roll. As the foam slab 25 is compressed between the projecting fingers 42, 43 the longer projecting fingers 42 intermesh and the outer ends of the longer projecting fingers 42, 43 engage or nearly contact or touch space between fingers on the mating convolute ring of the other convolute roll, as shown in FIGS. 4 and 5, thereby completely compressing the foam slab. The band knife blade 36 then cuts the foam to form a hole in the trough 22 between the peaks of the convolute foam pad produced.

The convolute rings 32 with longer projecting fingers 42 may be positioned at different points along the shafts 34 to create a foam mattress pad with a "zero base" or hole in the troughs. Preferably the rings 32 are spaced so as to provide punched areas 12, 14 that form a guide along which an individual may tear or cut off strips of foam material to decrease the size dimensions, (length or width) of the mattress pad.

While preferred embodiments of the invention have been described using specific terms, such description is for illustrative purposes only. Changes and variations may be made without departing from the spirit or scope of the invention as claimed herein.

We claim:

1. A method for forming a mattress pad of adjustable size, comprising:

convoluting a single slab of foam material by passing the slab without an auxiliary pad between convoluter rolls having a plurality of spaced apart projecting fingers with surfaces between the projecting fingers, each finger having a tip, where the fingers are positioned so that at least some of the fingers of one roll intermesh with the fingers of another roll and the tips of at least some fingers nearly contact the surface between the fingers of another roll to compress the foam; and cutting the foam slab with a knife blade positioned adjacent to the convoluter rolls so that the foam slab forms two foam pads with each pad having peaks and troughs on at least one surface, and the foam material is removed from at least some of the troughs of one of the pads to form holes between the peaks of the pad, with said holes forming a guide for tearing or cutting to remove portions of the foam to decrease the width or length of the pad.

2. The method of forming a mattress pad of claim 1, wherein:

the holes are formed in a row of troughs between the peaks of at least one of the foam pads.

3. The method of forming a mattress pad of claim 1, wherein:

the holes are formed in a column of troughs between the peaks of at least one of the foam pads.

4. The method of forming a mattress pad of claim 1, wherein:

at least some of the projecting fingers on at least one of the convoluting rolls are longer than other projecting fingers on the convoluting rolls so that the foam material between some of the peaks of one of the foam pads is cut by the knife to form the holes through the pad in the troughs between some of the peaks of the foam pad.

5. The method of forming a mattress pad of claim 2, wherein:

the holes are cut through no more than four rows of troughs between the peaks of at least one of the foam pads.

6. The method of forming a mattress pad of claim 3, wherein:

the holes are cut through no more than four rows of troughs between the peaks of at least one of the foam pads.

7. The method of forming a mattress pad of claim 1, wherein the single slab is passed through the convoluter rolls only a single time.

8. A method for adjusting the size of a mattress pad, comprising:

providing a foam pad having an initial length and width to conform substantially to a queen-sized mattress and having a perforated or punched guide for tearing or cutting; and tearing or cutting a strip of foam material of predetermined length, width and thickness from the foam pad so that after the strip is torn or cut away, the pad has a length and width to conform substantially to a standard full size bed mattress; and rolling or folding the removed strip of foam material and placing the rolled or folded foam material in a casing to form a pillow.

9. The method of claim 8, wherein:

the foam pad has an initial length and width to conform substantially to a queen-sized mattress and after the foam strip is removed the pad has a length and width to conform substantially to a twin-sized mattress.

10. A method for adjusting the size of a mattress pad, comprising:

providing a foam pad having an initial length and width to conform substantially to a king-size mattress and having a perforated or punched guide for tearing or cutting; and tearing or cutting a strip of foam material of predetermined length, width and thickness from the foam pad so that after the strip is tom or cut away the pad has a length and width to conform substantially to a standard full-size bed mattress; and rolling or folding the removed strip of foam material and placing the rolled or folded foam material in a casing to form a pillow.

11. The method of claim 10, wherein the foam pad has an initial length and width to conform substantially to a king-size mattress and the perforated or punched guide for tearing or cutting is located in a different position so that after the strip is torn or cut away, both the cutaway strip and the remaining foam pad each separately have a length and width to conform substantially to a twin-size bed mattress.

* * * * *